US008540388B1

(12) United States Patent
Chen

(10) Patent No.: US 8,540,388 B1
(45) Date of Patent: Sep. 24, 2013

(54) LIT BILLFOLD

(76) Inventor: Yi-Ting Chen, Taichung (TW)

( * ) Notice: Subject to any disclaimer, the term of this patent is extended or adjusted under 35 U.S.C. 154(b) by 172 days.

(21) Appl. No.: 13/229,754

(22) Filed: Sep. 11, 2011

(51) Int. Cl.
*A47B 19/00* (2006.01)

(52) U.S. Cl.
USPC ..... 362/98; 362/155

(58) Field of Classification Search
USPC ..... 362/98–99, 154–155
See application file for complete search history.

(56) References Cited

U.S. PATENT DOCUMENTS

| | | | |
|---|---|---|---|
| 5,639,156 | A | 6/1997 | Broxson |
| 5,688,037 | A | 11/1997 | Chen |
| 5,813,748 | A | 9/1998 | Maxymych |
| 6,302,563 | B1 | 10/2001 | Yama |
| 6,409,357 | B1 | 6/2002 | Thompson et al. |
| 6,637,907 | B1 | 10/2003 | Levy |
| 6,808,208 | B2 | 10/2004 | Ward |
| 7,128,433 | B2 | 10/2006 | Schosser |
| 7,163,307 | B1 | 1/2007 | Clark et al. |
| 7,270,437 | B1 | 9/2007 | Racoosin et al. |
| 7,549,762 | B2 | 6/2009 | Dinnerstein et al. |
| 7,559,665 | B1 | 7/2009 | Pfanstiehl |
| 2006/0187655 | A1 | 8/2006 | Bryerman et al. |
| 2006/0232953 | A1 | 10/2006 | Sanders |

OTHER PUBLICATIONS

H. Risch, Inc., Internet website entitled "Risch the Menu Cover People", URL http://www.hrisch.com/default.html, Rochester, New York, USA, a product entitled "Guest Check Presenter w/ LED".
LED Menu Innovations, LLC, internet website entitled "LED Menu Innovations", URL http://www.ledmenuinno.com/index.htm, Houston, Texas, USA, product entitled "LED Check Presenter".

*Primary Examiner* — Jason Moon Han
(74) *Attorney, Agent, or Firm* — Yau Law Firm; Jo-Anne Yau

(57) ABSTRACT

A lit billfold for displaying and illuminating checks in dimly lit restaurants includes front and back covers, a document securing means, and a document illuminating means. The document securing means includes a plurality of straps attached to the edge of the inner surface of one of the front or back covers. The document illuminating means includes a light guide panel with a light source and a switch means, which both electrically connect to a power source located in a power source housing. Folding the light guide panel open toggles the switch means and activates the light source. Folding the light guide panel closed again toggles the switch means and deactivates the light source.

13 Claims, 9 Drawing Sheets

LIT BILLFOLD

CROSS-REFERENCE TO RELATED APPLICATIONS

Not applicable.

FEDERALLY SPONSORED RESEARCH

Not applicable.

SEQUENCE LISTING OR PROGRAM

Not applicable.

FIELD OF THE INVENTION

This invention generally relates to illuminated document displays and holders in restaurants. Specifically, this invention relates to a lit billfold device for use with, but not limited to, displaying and illuminating restaurant checks or other documents under dim lighting conditions.

BACKGROUND OF THE INVENTION

Restaurants and other service establishments typically use lighting to attract customers. Restaurants in particular use dim lighting in the dining area to create an intimate ambiance and create an enjoyable dining experience. However, the decreased illumination may cause a problem if the patron is unable to read the invoice information printed on the check. Without being able to read the check, the patron may commit errors in calculating the gratuity or final payment amount, leading to frustration for both the patron as well as restaurant staff. Some patrons may even be embarrassed to request assistance in reading the check and as a result may decide not to return to the restaurant.

While increased illumination may be desirable for patrons needing to read the check at the end of a dining experience, it is intrusive to patrons in the immediate vicinity who are still enjoying their meal. For this reason, typical illumination devices such as miniature lamps or table lights, while welcome by those having difficulty reading in low light, are distracting to other patrons nearby.

Candles may provide an appropriate amount of light to illuminate a check while not detracting from the restaurant's atmosphere. However, that type of lighting is hazardous in establishments where the candle can easily topple from the table and cause fire, exposing patrons to injuries and restaurant owners to liability.

Accordingly, a solution that satisfies the restaurant owner's best interests in serving patrons is one that enables patrons to read checks under dim lighting yet does not distract from the dining experiences of others. Restaurant patrons seek an enjoyable, stress free dining experience. Similarly, restaurant owners seek to provide such an experience to keep customers coming back. Additionally, restaurant owners need an effective method of delivering billing information.

The prior art in this field reveals numerous devices that hold, display, or illuminate restaurant checks and other documents in dim light conditions. However, the present invention provides a solution in areas where the prior art does not.

The prior art has attempted to overcome the aforementioned problems with a fixed light source. The illumination device for a guest check presenter in U.S. Pat. No. 7,270,437 to Racoosin et al. discloses a light source housing mounted onto a guest check presenter. The light is positioned to aim directly down at the check and is activated with a push-button switch. However, there is no way of automatically activating and deactivating the light source, a feature found in the present invention. Also, the fixed light source allows only for illumination of one portion of the check. The present invention solves this problem by providing a light source mounted on an adjustable light guide panel, which illuminates the entire document.

Another fixed light source example, the lighted bill folder in U.S. application Ser. No. 11/220,459 to Bryerman et al. discloses a folder, which, when opened, activates a light inside of a housing near the top of the folder. The light activates and deactivates when the folder is opened and closed. The illuminated billfold, portfolio, book and the like in U.S. Pat. No. 6,409,357 to Thompson et al., discloses front and back covers where the inner surface of one or both of the covers holds a restaurant check. One or both inner surfaces also include a light with an overhang. The overhang directs light at the check held by the respective cover. An electric switch energizes the light as the covers are opened. Additionally, the book light for simultaneously opening the shade and actuating the switch in U.S. Pat. No. 5,688,037 to Chen, discloses a light source with a shade that pivotally attaches to a folder with a clamp. A switch turns the light off and on when the shade closes and opens. These examples employ fixed light sources. As mentioned before, the fixed light configuration does not illuminate the entire document. The present invention overcomes this by providing a light source situated on a adjustable light guide panel.

The prior art also includes several portfolio-like document holders with the light source attached to the opposite cover as the cover holding the document. The illuminated document holder in U.S. Pat. No. 7,559,665 to Pfanstiehl, discloses a document holder that activates a lamp when the front and back covers reach predetermined angles. This prior art may be difficult to operate for some users. A user who is unaware of the proper angle to hold the menu may not enjoy the benefits of the invention. The illuminated document caddy in U.S. Pat. No. 7,163,307 to Clark et al. discloses a back cover holding a document and a front cover containing a light source. Alternatively, the light source may be located on the same cover as the document. A hood mounted over the light source prevents excess light from disturbing others nearby. A pressure switch activates and deactivates the light when the user opens and closes the covers. In the above examples, the light source being attached to one of the portfolio covers limits the degree in which the user may selectively illuminate portions of the check because the user must adjust the entire cover to alter the illumination. On the other hand, the present invention substantially departs from this trend by employing a user-friendly interface as well as a means to selectively illuminate the desired portion of the check without having to adjust the entire cover of the device.

The guest check presenter in U.S. Pat. No. 7,128,433 to Schlosser also discloses a portfolio with top and bottom covers and a plastic magnifying sheet disposed in between the covers. The bottom cover holds a document. The top cover houses a light source, which illuminates the document by directing light through the magnifying sheet. The light source is operated by a manual switch. This prior art does not feature a means to automatically shut off the light source. Therefore leaving the device unattended in the on position after use will result in unnecessary battery drain. Also, use of the magnifying sheet may be problematic to users unfamiliar with how the device works. The magnifying sheet may further reflect glare back into the eyes of the user. However, operation and execution of the present invention is easy. The user quickly discovers how to operate the lit billfold by simply opening the light guide panel, which automatically activates the light.

The food/drink tab/check holder in U.S. Pat. No. 6,808,208 to Ward discloses a book with front and back covers. One cover holds a document while the other cover contains a light-emitting assembly and a switch to deactivate the light when the covers are closed. The cover holding the document also includes a sliding magnifying member to assist users in reading small print. This prior art also requires the user to adjust the entire cover to illuminate different portions of the check.

The lighted check holder device in U.S. Pat. No. 6,302,563 to Yama discloses a box-like check support member with a hinged cover. An elongated light support member, with a switch and a light-emitting member on one end, is pivotally attached to the check support member at the other end. The box-like construction makes this device bulky and difficult to store in restaurants with limited space. Further, there is no automatic switch for activating or deactivating the light. The present invention overcomes these issues because it is roughly the same size as a normal restaurant billfold and includes a mechanism for automatically turning off the light when not in use.

U.S. Pat. No. 5,813,748 to Maxymych discloses an illuminated transaction tray with a hinged lid and an electroluminescent strip to light a restaurant bill held in a recess in the tray. The electroluminescent strip is arranged around the inner wall of the recessed area. With this device, there is no way to adjust the light to illuminate different parts of the check. The present invention substantially departs from this prior art by providing the user the means to selectively illuminate a desired portion of the check by adjusting the light guide panel.

The device for illuminating reading material in U.S. Pat. No. 7,549,762 to Dinnerstein et al. discloses a two-paneled portfolio with a third smaller panel. The third panel hingedly attaches to one of the first two panels and has a light module, which casts light onto a document held by the portfolio. The light source may be activated when the user depresses and holds a push button switch. Alternately, the light module may feature a timer to automatically deactivate the light after a predetermined amount of time. The present invention departs from this prior art by featuring a light guide panel that automatically closes, thereby deactivating the light source, when the user lets go of the guide panel.

Therefore, it can be appreciated that there exists a need for a lit billfold, which can be used for holding, displaying, and illuminating restaurant checks in restaurants with dim lighting conditions. In this regard, the present invention substantially fulfills this need.

SUMMARY OF THE INVENTION

Accordingly, the present invention is a lit billfold for holding and illuminating restaurant checks under dim lighting conditions. Of course, the purpose of the device is not limited illuminating checks in restaurants but may also be applied to other situations. The device may be adapted to any number of applications where a user is required to read printed materials under low light levels and where the maintenance of such low light levels is important to others nearby. For example, the present invention may be used with bills and checks in intimate live performance venues, dark nightclubs, or wine and cigar bars. Additionally, the device may be used to hold and illuminate theatre programs in dark theatres. The present invention effectively provides the user with the optimal level of illumination; there is enough light to accurately read printed text, but not so much light to interfere with the surrounding area.

In general, the present invention is comprised of a front and back cover, hingedly joined with a spine. Each cover includes an inner surface and an outer surface. The device also includes a document securing means, a power source housing, and a means of illuminating a document.

The means of securing a document preferably includes a plurality of straps located along the bottom edge of the inner surface of at least one cover. Each strap receives a bottom edge of a restaurant check or other document, thereby securing it to the device.

The power source housing includes a power terminal and a power control regulator. The power source housing receives a portable power source, preferably a plurality of batteries, which removably couples to the power terminal. The power terminal and power control regulator are both electrically connected to the means of illuminating a document.

The means of illuminating a document includes a light guide panel hingedly attached to the edge of the inner surface of one or both covers. The light guide panel folds away from the inner surface of the cover to open and folds toward the inner surface the cover to close. A light source is contained in the light guide panel. The light source is activated when the light guide panel is opened and deactivated when the light guide panel is closed. The light source directs light onto the check held by the document securing means. By adjusting the light guide panel, the user may selectively illuminate different portions of the check. Because of this feature, the device does not require bright lights for the light source.

The document illuminating means also includes a switch means. The switch means includes a reed switch situated in the attached cover and a switch magnet situated in the light guide panel. The reed switch and switch magnet are aligned so that opening and closing the light guide panel toggles the switch means and activates and deactivates the light source.

Thus, the general features of the invention have been broadly outlined, such that the detailed description thereof that follows may be better understood. There are, of course, additional features of the invention that will be described, which will form the subject matter of the claims. The claims should be regarded as providing the limits of the present invention. It is to be noted that the invention is not limited to the details of construction, or to the arrangements of the elements set forth in the following description or representations in the figures. The invention is capable of other embodiments and of being used in a variety of ways for a multitude of purposes. Also, it is to be understood that the phraseology and terminology employed herein are for the purpose of description, and should not be regarded as limiting.

It is thus an object of this present invention to provide a lit billfold allowing for the display and illumination of a restaurant check under dim lighting conditions while not interrupting the enjoyment of others. The present invention provides light specifically to the material the user wishes to read and does not disturb other non-users in the vicinity.

It is a further object of the present invention to provide a lit billfold, which may be easily adapted for displaying various documents. In this manner, one document may be removed from the device and replaced by another document.

It is a further object of the present invention to provide a lit billfold with efficient power consumption and inexpensive operating costs, accomplished in part by a mechanism to automatically switch the device off.

It is yet another object of the present invention to provide a lit billfold that can be used in conditions with both dim lighting and normal lighting levels.

It is another object of the present invention to provide a lit billfold with a simple user interface that can be easily activated by a non-sophisticated user.

It is still further an object of the present invention to provide a lit billfold that is battery powered and able to be easily moved from one location to another.

It is yet further an object of the present invention to provide a lit billfold that requires little or no assembly on part of the user.

It is another object of the present invention to provide a lit billfold, which may be easily and efficiently manufactured and marketed.

An additional object of the present invention is to provide a lit billfold that has a minimal number of moving parts and may easily be repaired if damaged.

It is another object of the present invention to provide a lit billfold, which provides advantages over the prior art, while simultaneously overcoming the disadvantages of the prior art.

These, together with other objects of the invention, along with the various features of novelty, which characterize the invention, are pointed out with particularity in the claims, which are a part of this disclosure. For a better understanding of the invention, its operating advantages and the specific objects attained by its uses, reference should be made to the accompanying description and figures, in which there are illustrated preferred embodiments of the invention.

Further objects and advantages of this invention will become apparent from a consideration of the drawings and ensuing description.

While the above description contains many specifications, these should not be construed as limitations on the scope of the invention, but as exemplifications of the presently preferred embodiments thereof. Thus, the scope of the invention should be determined by the appended claims and their legal equivalents, and not by the examples given. Many other ramifications and variations are possible within the teachings of the invention. The lit billfold can be used in settings other than displaying and illuminating a restaurant bill in dim lighting conditions. For example, the device may be used in dimly lit nightclubs, wine bars, or performing art venues.

In view of the foregoing disadvantages inherent in the known types of lighted document displays present in the prior art, the present invention provides a lit billfold. As such, the general purpose of the present invention, which will be described in greater detail, is to provide a device, which has all the advantages of the prior art, and none of the disadvantages.

DRAWINGS—FIGURES

The features and advantages of the present invention will be better understood and objects other than those set forth will become apparent when consideration is given to the following detailed description thereof. Such description makes reference to the annexed drawings wherein.

DRAWINGS—REFERENCE NUMERALS

Figure 1:
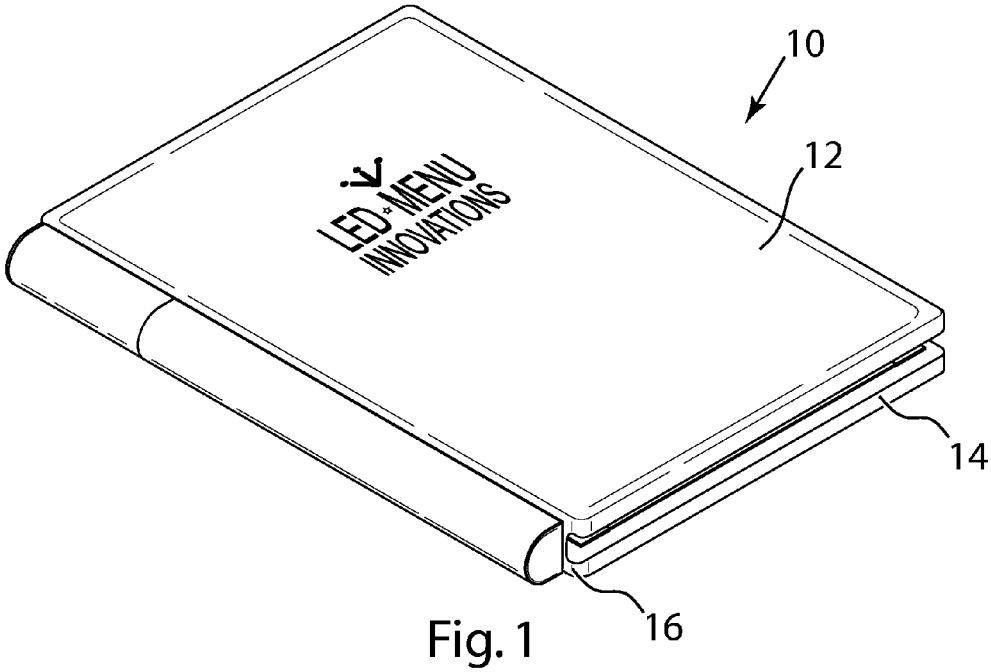
FIG. 1 is a perspective view of a lit billfold showing the front and back covers in a closed position.
Figure 2:
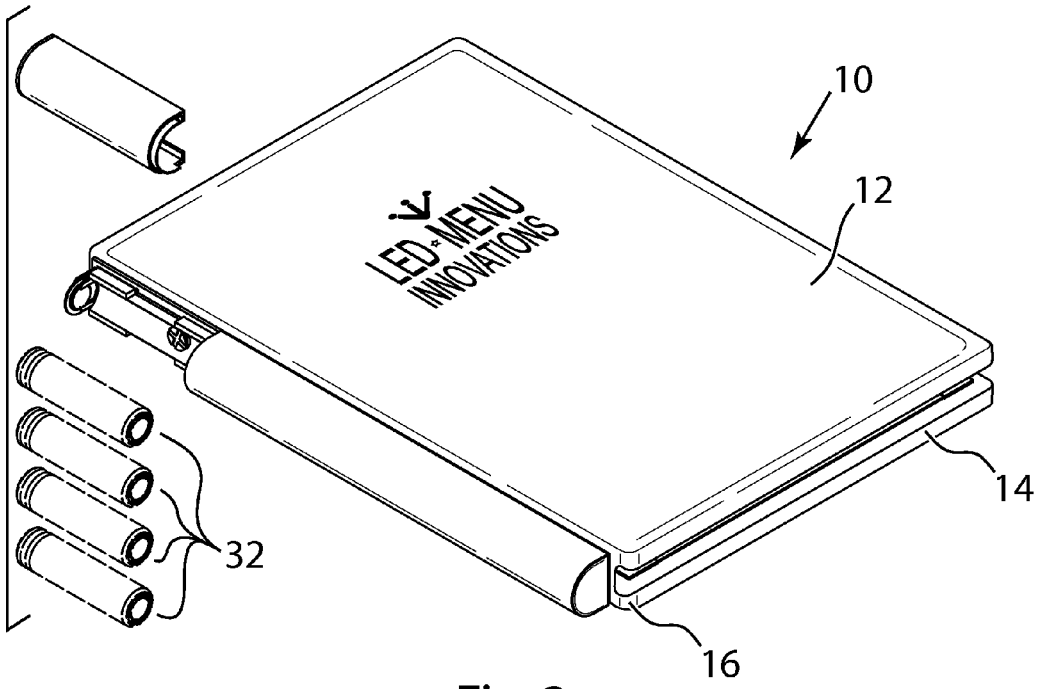
FIG. 2 is a perspective view of the lit billfold showing the front and back covers in a closed position and featuring the power source removed from the power source housing.

| | |
|---|---|
| 10 | Lit billfold |
| 12 | Front cover |
| 14 | Back cover |
| 16 | Spine |
| 18 | Credit card pocket |
| 20 | Document securing means |
| 22 | Strap |
| 24 | Power source housing |
| 26 | Power terminal |
| 28 | Power control regulator |
| 30 | Power source |
| 32 | Plurality of batteries |
| 34 | Hatch door |
| 36 | Means of illuminating a document |
| 38 | Light guide panel |
| 40 | Light guide panel magnet |
| 42 | Light source |
| 44 | Plurality of light emitting diodes |
| 46 | Switch means |
| 48 | Reed switch |
| 50 | Switch Magnet |
| 60 | Partition |
| 10' | Lit Billfold (alternate embodiment) |
| 20' | Document securing means (alternate embodiment) |
| 36' | Means of illuminating a document (alternate embodiment) |

DESCRIPTION OF THE INVENTION

With reference now to the drawings, and in particular, FIGS. 1-12, for a lit billfold for holding and illuminating restaurant checks and other documents in dimly lit environments, as generally designated by the reference numeral 10, the principles and concepts of the present invention will be described.

The present invention, the lit billfold, is comprised of a plurality of components. Such components, in a broad sense, preferably include a front and a back cover, a document securing means, a power source housing, a power terminal, a power control regulator, a power source, and a means of illuminating a document. As described below, these elements and various sub elements contained therein combine to provide a user with many novel benefits.

Figure 3:
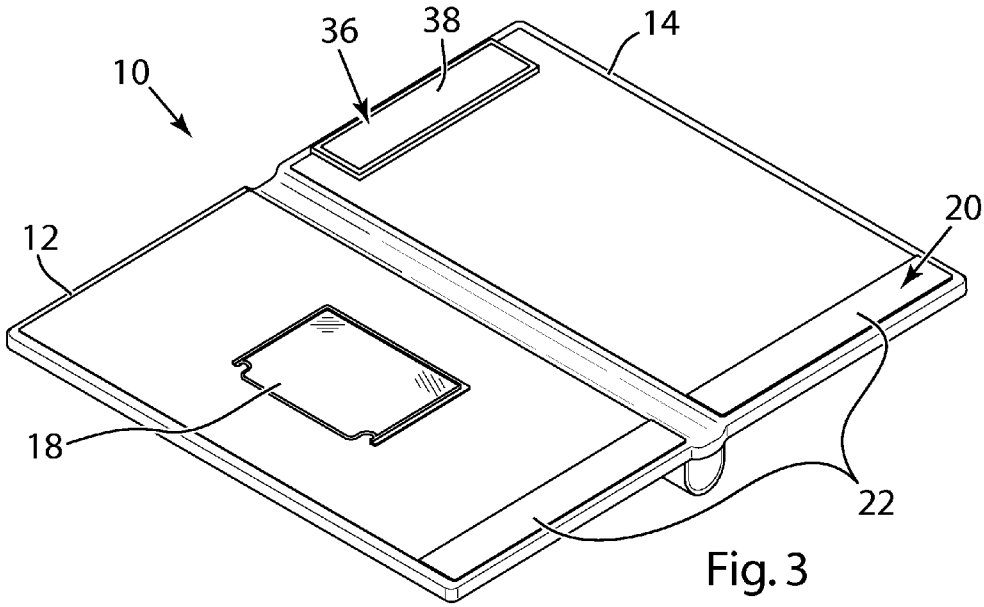
FIG. 3 is a perspective view of the lit billfold showing the front and back covers in an open position, with an uninserted document.
Figure 4:
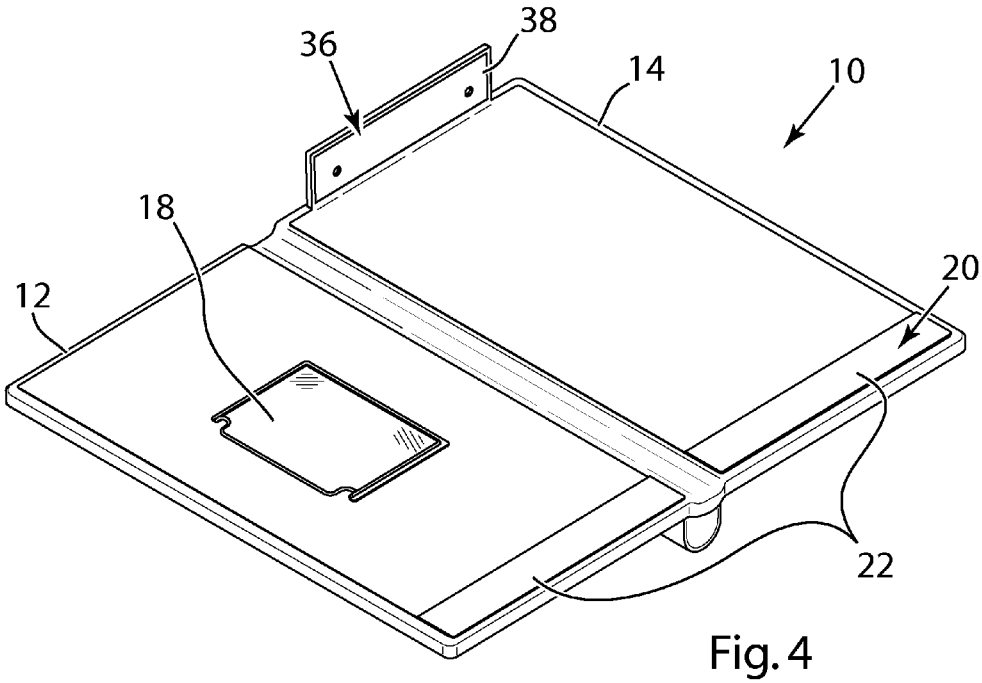
FIG. 4 is a perspective view of the lit billfold showing the front and back covers in an open position with a document inserted into the document securing means.

FIGS. 1-4 show a lit billfold 10 having a front cover 12 and a back cover 14 hingedly joined by a spine 16. The covers 12, 14 are preferably constructed from rigid durable cardboard covered with vinyl or simulated leather. However, the covers 12, 14 may be constructed from any suitable material, as is apparent to one skilled in the art. Each cover 12, 14 has an inner surface, which is hidden from view when the covers 12, 14 are closed, as seen specifically in FIGS. 1 and 2, as well as an outer surface, which is exposed only when the covers 12, 14 are open, as is depicted in FIGS. 3 and 4. At least one of the inner surfaces may include a credit card pocket 18 designed to secure a credit card or other currency after the user has reviewed the check and decides to pay.

Now referring to FIGS. 3 and 4, the device 10 includes a document securing means 20, which includes a plurality of straps 22 preferably attached along the edge of the inner surface of at least one of the front or back covers 12, 14. In the preferred embodiment, the straps 22 are attached along the bottom edge, but may also attach along the top edge as well. Each strap 22 preferably secures the bottom edge of the restaurant check or other document to be held. The user inserts the edge of a check into the strap 22. This prevents the check from sliding out of the device 10 while being transported through the restaurant. Further, the document securing means 20 prevents the check from being dislodged as the covers 12, 14 are opened.

Figure 5:
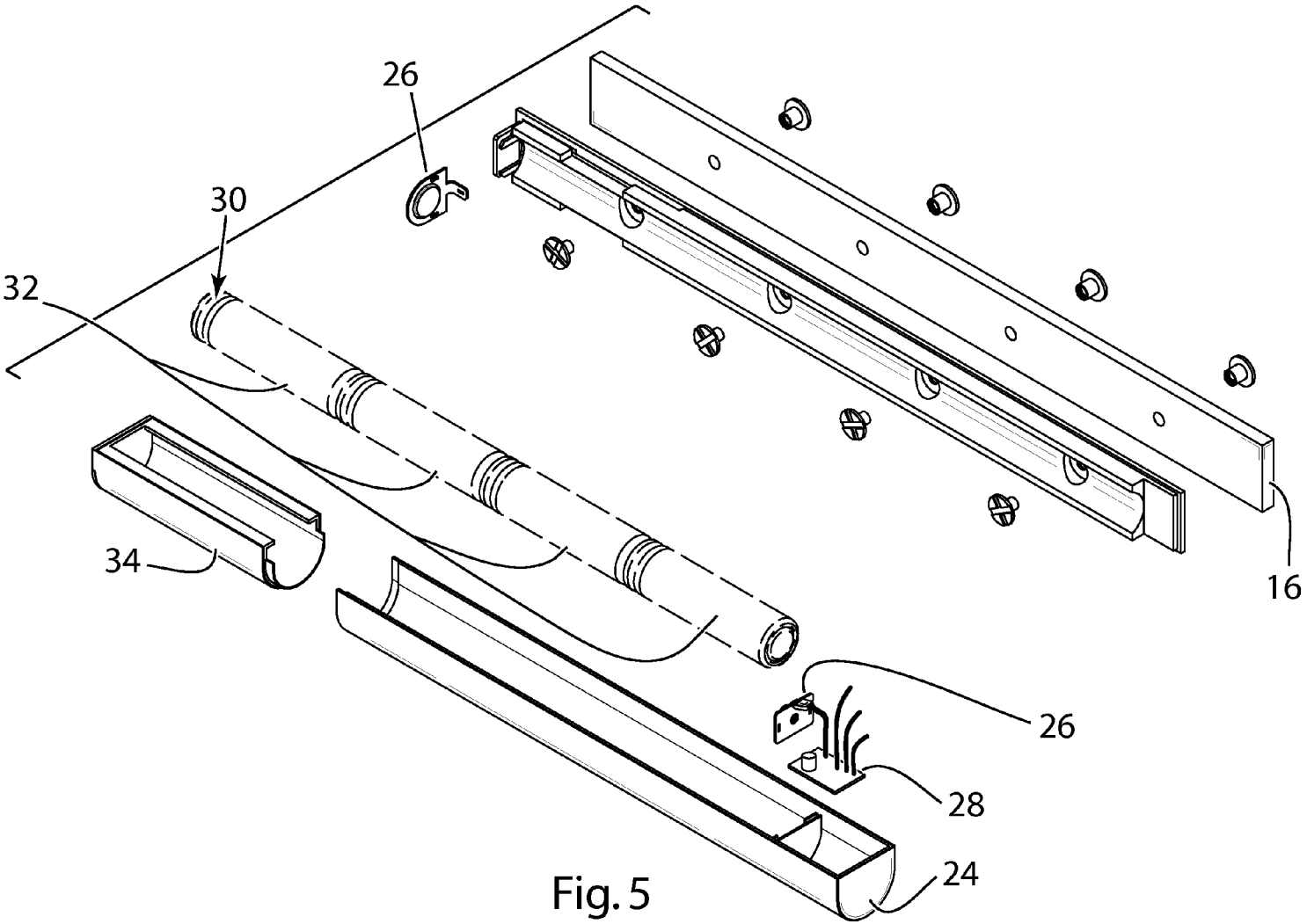
FIG. 5 is an exploded perspective view of the lit billfold showing the components of the power source housing, featuring the power terminals, power source, and the power control regulator.

As depicted in FIG. 5, a power source housing 24 is attached to the spine 16. The power source housing 24 contains a power terminal 26. The power terminal 26 is electrically connected to a power control regulator 28. A power source 30 is included and is removably coupled to the power terminal 26. The power control regulator 28 ensures consistent flow of electricity between the power source 30 and other components of the device 10. The power source 30 is preferably a plurality of batteries 32. Of course, the power source 30 may consist of disposable alkaline batteries or rechargeable nickel cadmium or lithium ion batteries, as is apparent to one skilled in the art. A removable hatch 34 provides convenient access to the power source housing 24. In this manner, the user may easily remove and replace depleted batteries 32. Additionally, with the power source 30 in the power source housing 24, near the spine 16, there are less restrictions on the size of the power source 30. For example, if the power source were located within one of the covers, power source options would be limited to low profile batteries.

The power source housing 24 is preferably constructed of durable plastic and covered with vinyl or simulated leather to match the front 12 and back 14 covers. Of course, the power source housing 24 may be constructed from any suitable material, as is apparent to one skilled in the art. In addition, the hatch 34 may employ a watertight seal to protect the power source 30 from careless or messy patrons.

Revisiting FIGS. 3 and 4, a means of illuminating a document 36 is attached to at least one of the covers 12, 14. In the preferred embodiment, the means of illuminating a document 36 is attached to the back cover 14. However, this component may readily be attached to the front cover 12 as well. In the preferred embodiment, the document illuminating means 36 includes a light guide panel 38 hingedly attached along the edge of the back cover 14. The document illuminating means 36 is closed when the light guide panel 38 completely folds over the inner surface of the attached cover 14, as is depicted in FIG. 3. The document illuminating means 36 is open when the light guide panel 38 folds away from the inner surface of the attached cover 14, as is depicted in FIG. 4.

Figure 6:
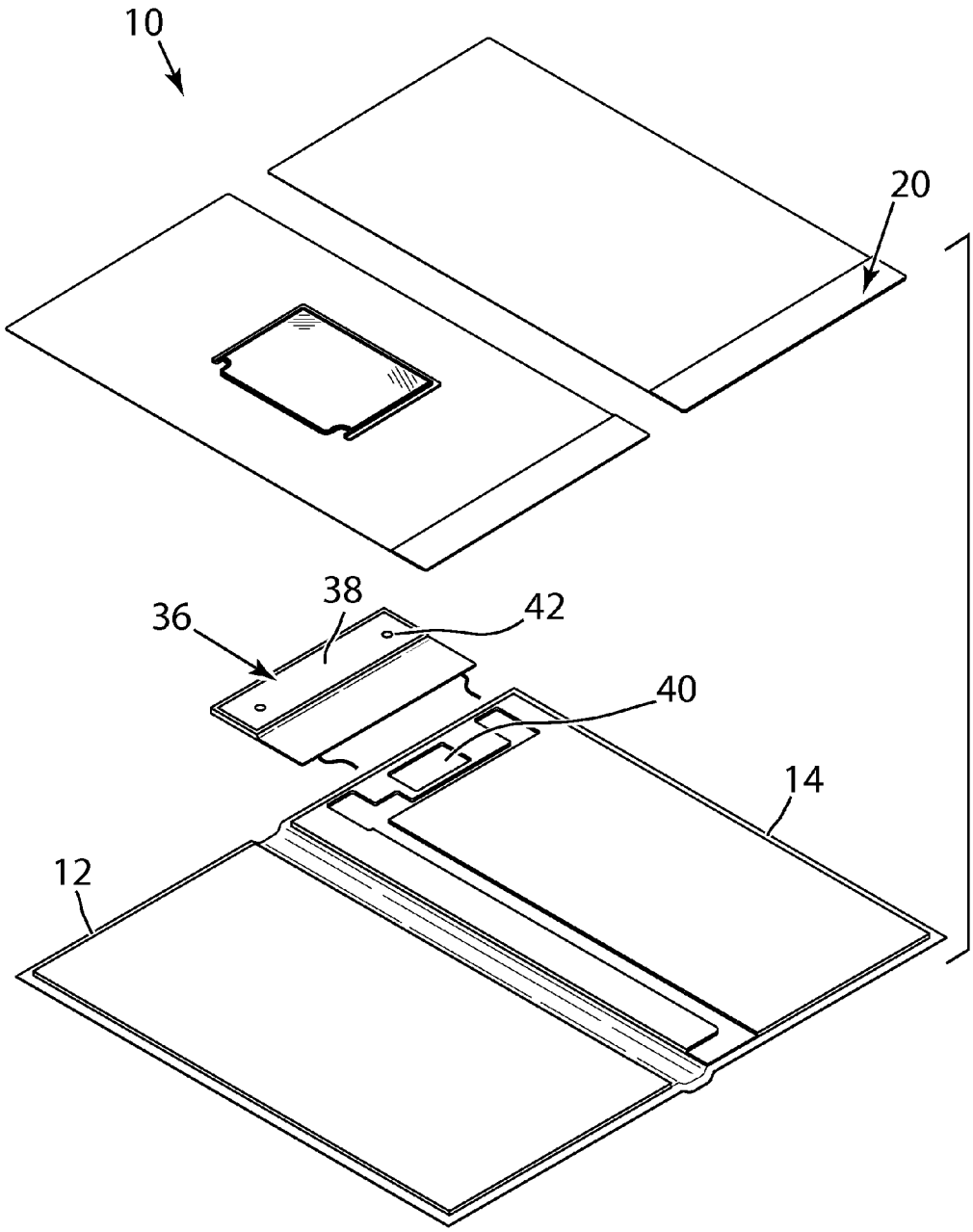
FIG. 6 is an exploded perspective view of the front and back covers showing the means of illuminating a document.
Figure 7:
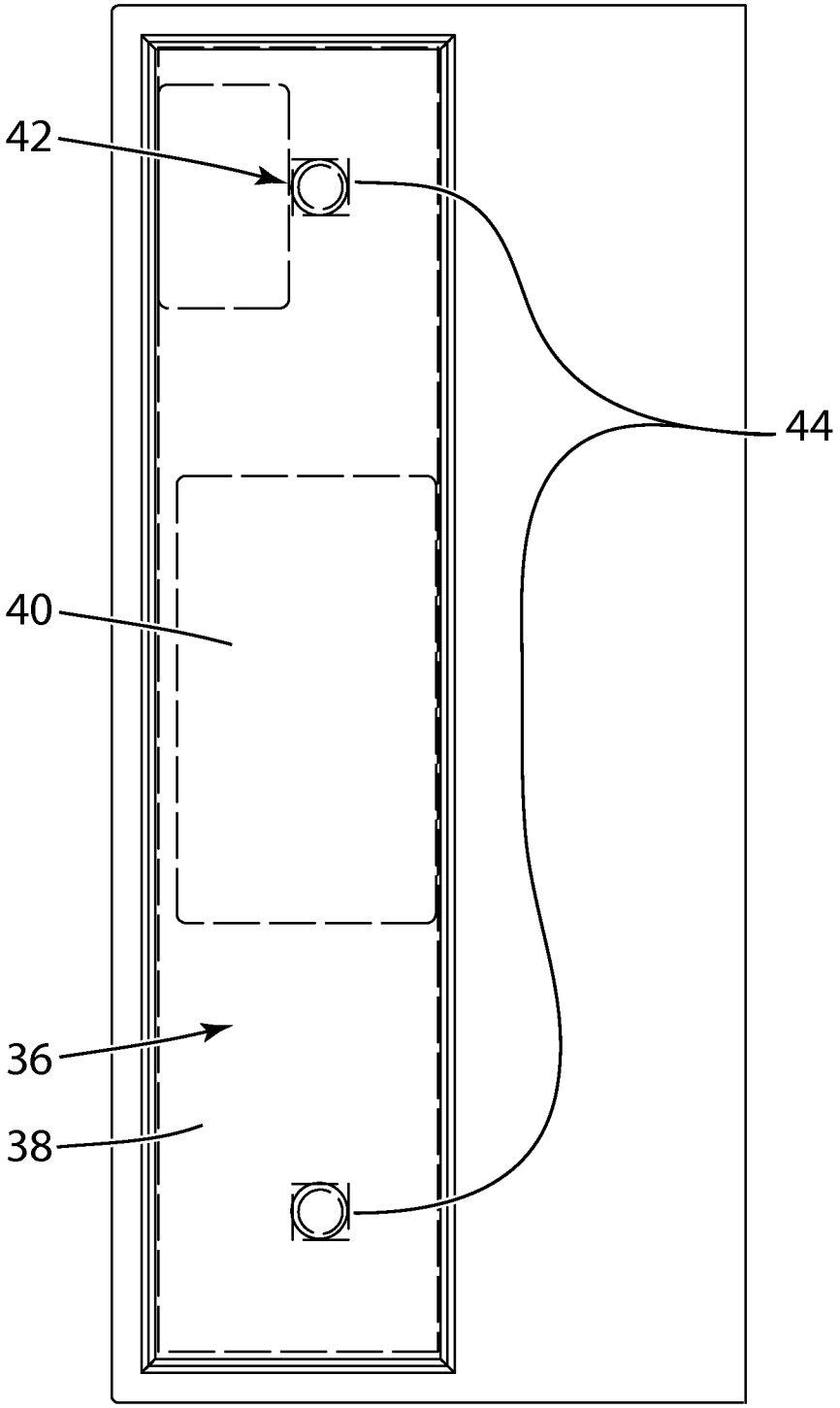
FIG. 7 is a front elevation view of the light guide panel showing the light source and indicating the position of the light guide panel magnet and the switch magnet.

Referring now to FIGS. 6 and 7, a set of light guide panel magnets 40 are oppositely situated within the light guide panel 38 and the attached cover 14. The light guide panel magnets 40 are strong enough to attract the light guide panel 38 toward the cover. The light guide panel 38 also includes a light source 42, which is preferably a plurality of light emitting diodes 44. Of course, the device 10 may employ any variety of light fixtures, such as fluorescent light bulbs or incandescent light bulbs, as is apparent to one skilled in the art. The light guide panel magnets 40 cause the document illuminating means 36 to default to a closed position. In this manner, the document illuminating means 36 closes when not in use. As explained below, this feature is beneficial because it automatically deactivates the light source 42 when the document illuminating means 36 is not in use. This conserves the power source because the user is not required to turn the device off.

The light source 42 is situated within the light guide panel 38 in such a way as to direct light onto the inner surface of the attached cover 14 or the document, if one is secured. In addition, adjusting the angle of the light guide panel 38 relative to the attached cover 14 alters the direction of illumination cast by the light source 42. The user may direct light to the area near the light guide panel 38 by adjusting the light guide panel 38 to a narrow angle. On the other hand, the user may direct light to the area further away from the light guide panel 38 by adjusting the light guide panel 38 to a wide angle. This feature conveniently allows the user to concentrate light to the area to be read without disrupting other users in the surrounding area.

Figure 8:
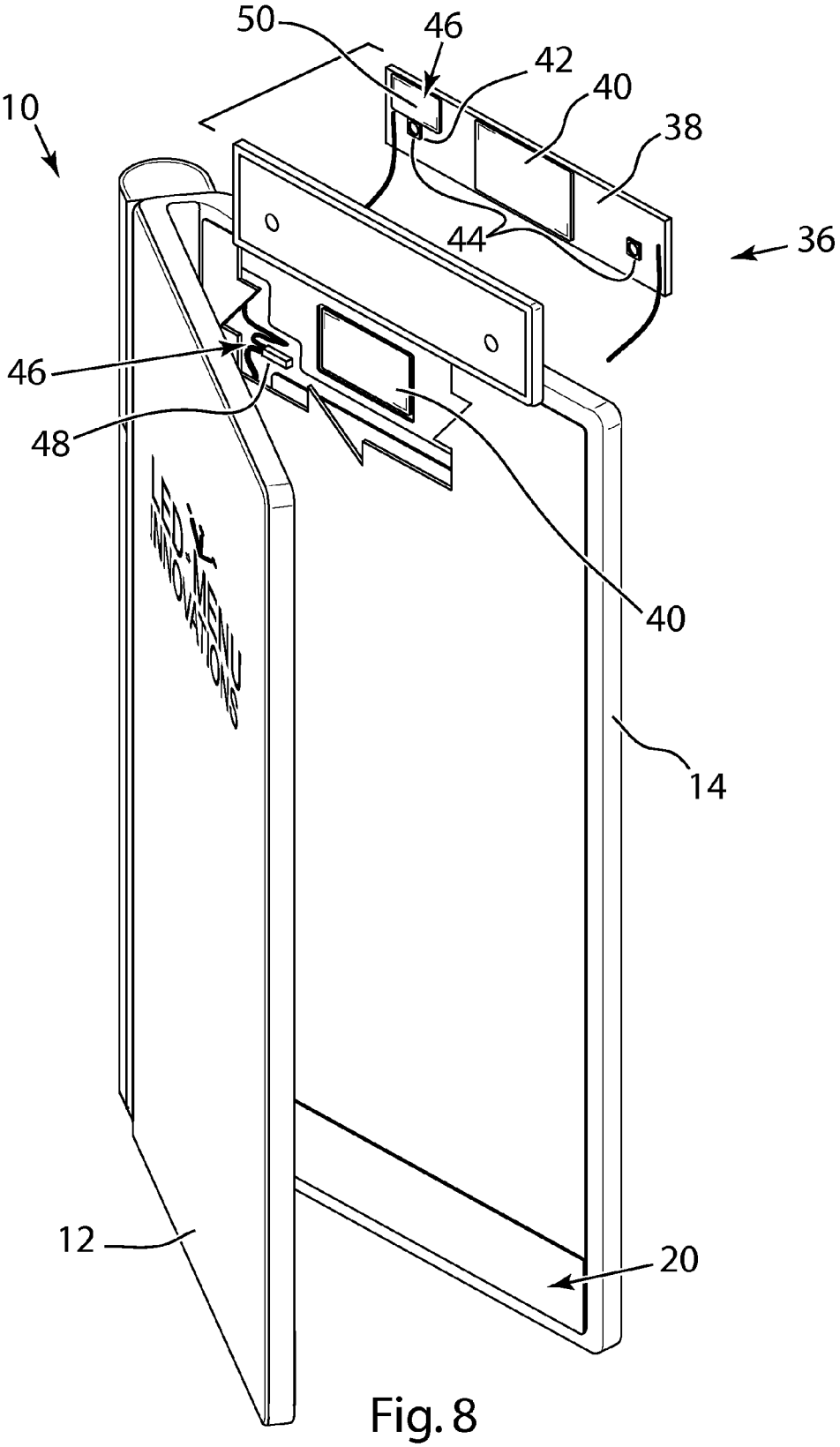
FIG. 8 is an exploded perspective view of the lit billfold showing the switch means.
Figure 9:
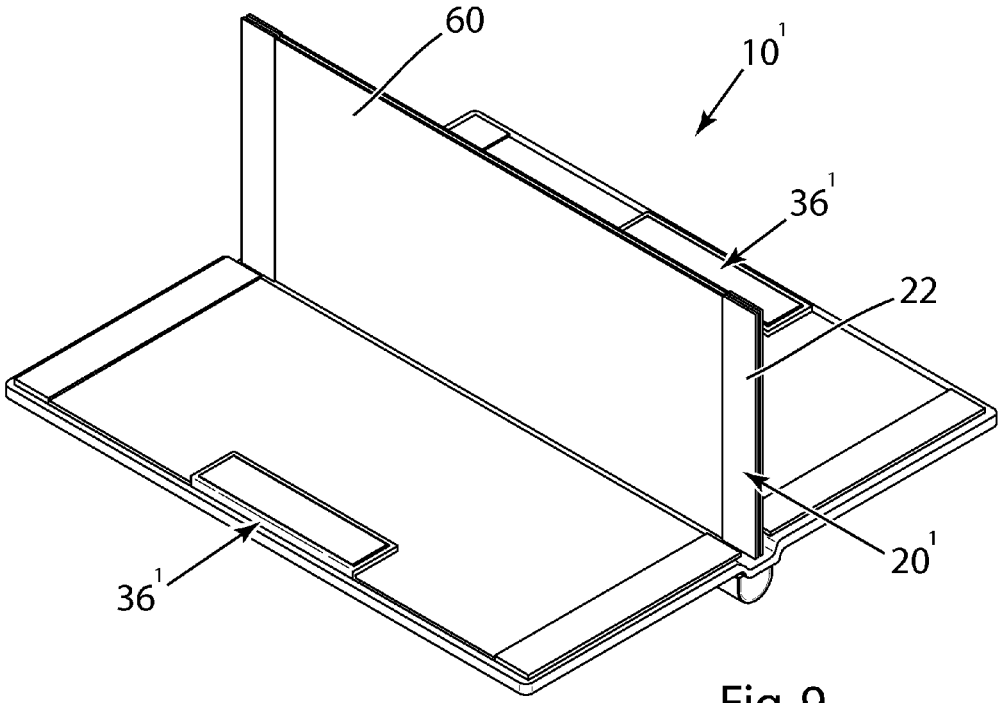
FIG. 9 is a perspective view of the alternate embodiment of the lit billfold in an open, position showing the partition and the means of illuminating a document in the closed position.
Figure 10:
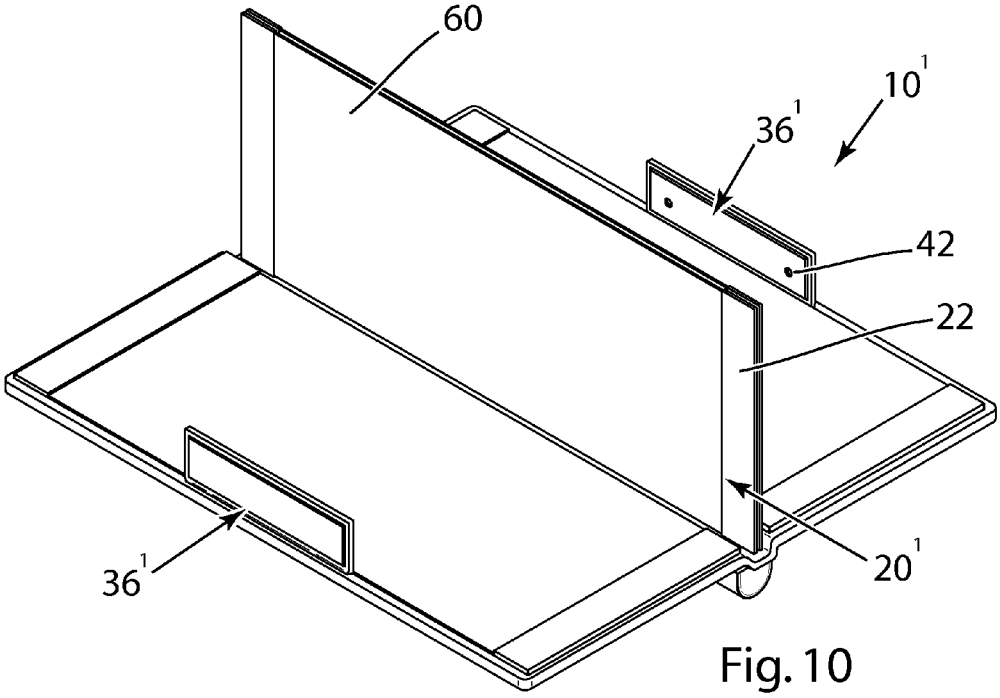
FIG. 10 is a perspective view of the alternate embodiment of the lit billfold in an open position showing the partition and the means of illuminating a document in the open position.
Figure 11:
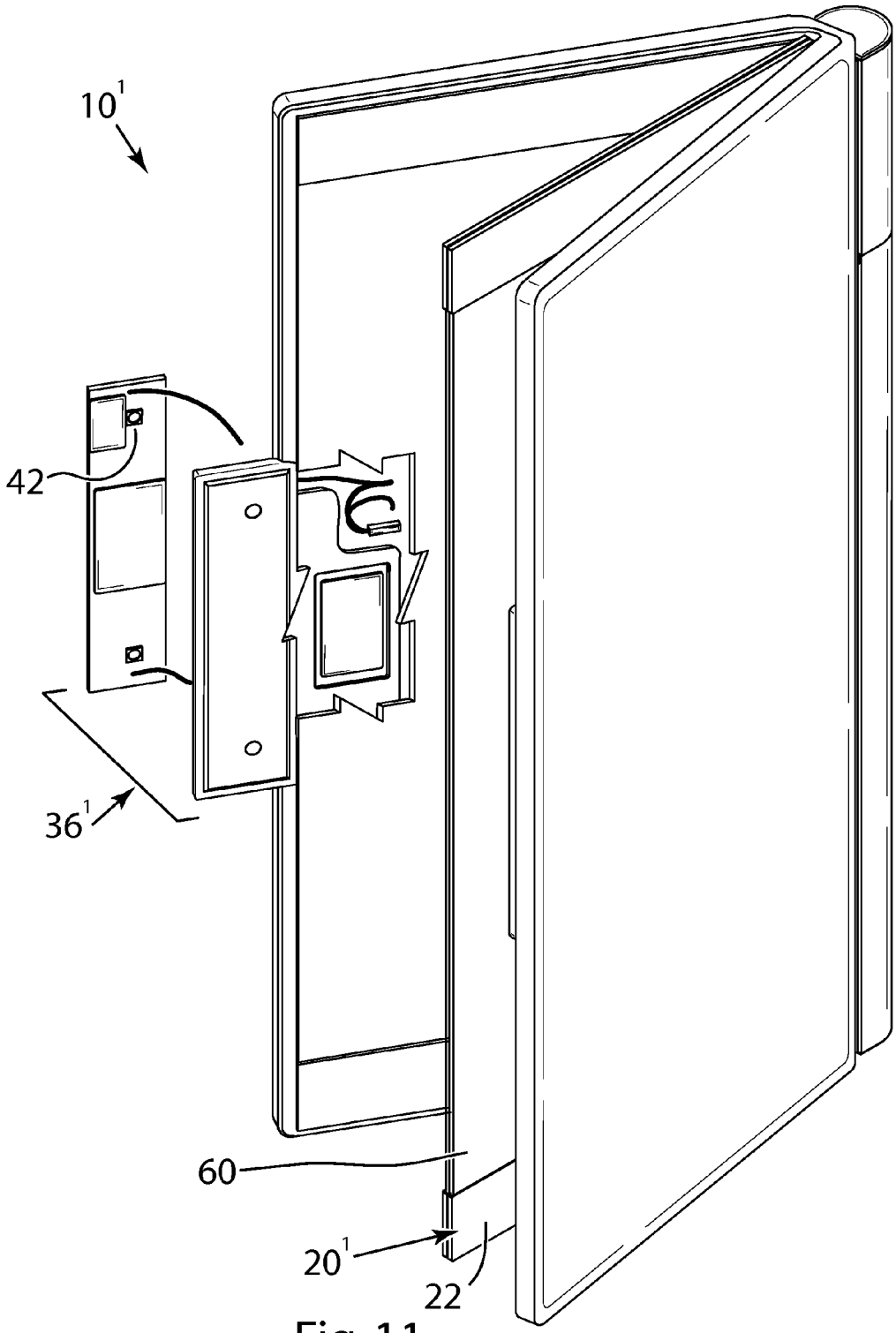
FIG. 11 is an exploded perspective view of the alternate embodiment of the lit billfold showing the means of illuminating a document.
Figure 12:
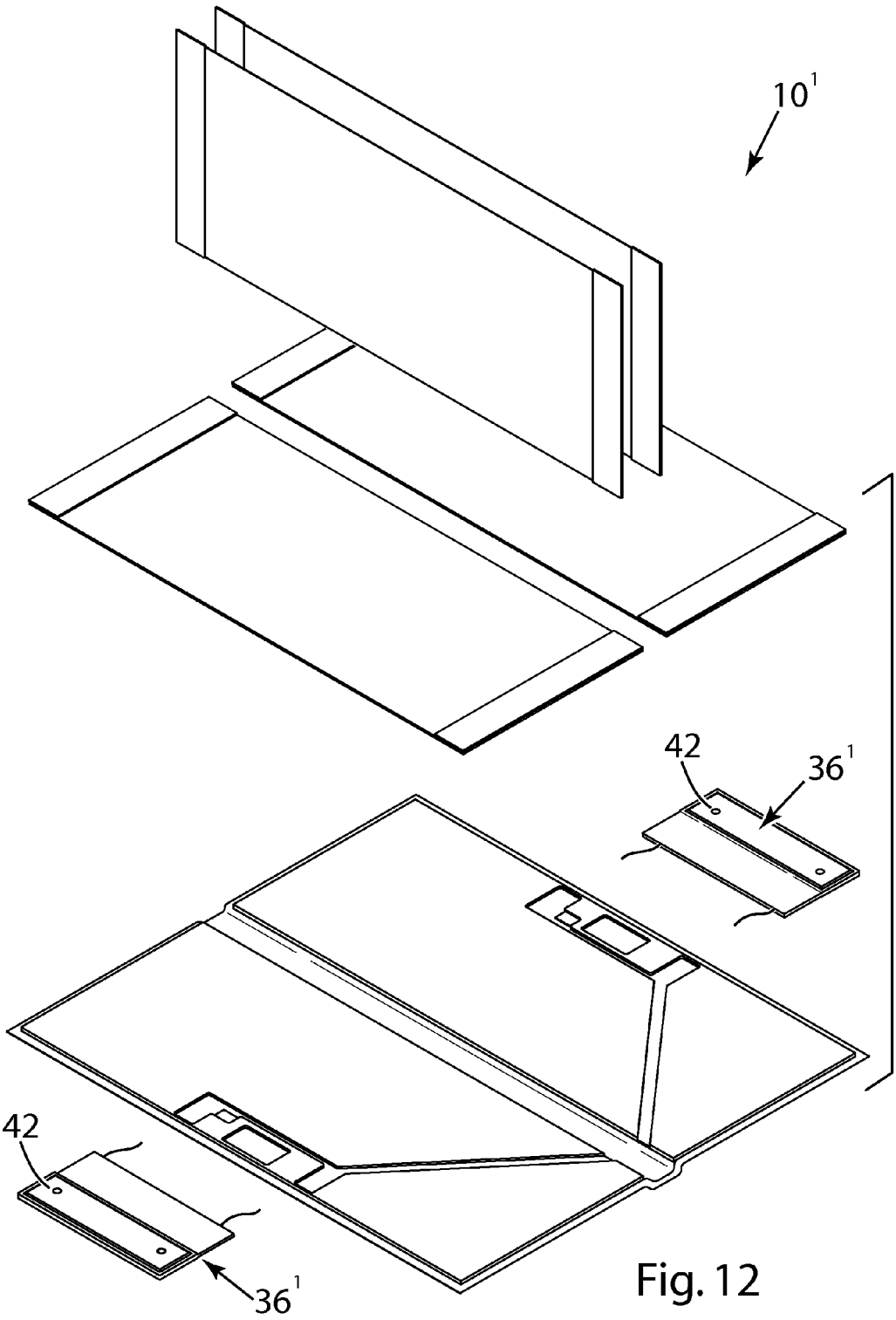
FIG. 12 is an exploded perspective view of the alternate embodiment of the lit billfold showing the components of the means of illuminating a document and the document securing means as well as the partitions.

Referring to FIG. 8, the document illuminating means 36 also includes a switch means 46. The switch means 46 includes a reed switch 48 embedded in the attached cover 14. The switch means 42 also includes a switch magnet 50 situated within the light guide panel 38. The reed switch 48 and switch magnet 50 are aligned so that opening and closing the light guide panel 38 toggles the reed switch 48 thereby activating and deactivating the light source 42, as explained below.

The power source 30, the power terminal 26, and the power control regulator 28 electrically connect with the light source 42 and the reed switch 48 to form an electric circuit. The light source 42 activates when the circuit is closed and deactivates when the circuit is open, the reed switch 44 controls the light source 40 by closing and opening the circuit as the light guide panel 38 is opened and closed, respectively. Therefore, when the light guide panel 38 is open, the reed switch 48 activates the light source 42 by closing the circuit. When the light guide panel 38 is closed, the reed switch 48 deactivates the light source 42 by the opening the circuit. This user interface is advantageous in that no special instructions are required to operate the device 10. Because the default position of the light guide panel 38 is closed, the light source 42 is deactivated unless there is user actuation.

In an alternate embodiment of the present invention 10', as seen in FIGS. 9-12, a partition 60 may be foldable attached to the spine 16 and disposed between the front 12 and back 14 covers. The partition 60 may also include a document securing means 20', preferably in the form of straps 22 along the top or bottom edge thereof. The alternative embodiment 10' may also include a means of illuminating a document 36' on both the front 12 and back 14 covers. This configuration is advantageous in a restaurant situation where multiple parties dine together. The patrons may wish to keep the check amounts confidential. To respect this privacy, restaurant staff may present a separate check on each side of the partition 60. In this manner, each paying party uses the document illuminating means 36' on each side of the partition 60 to examine the respective bill without seeing the other party's check.

It should be noted that the mechanics and circuitry operate the same in the alternate embodiment 10' as in the preferred embodiment. Therefore, the user interface is the same Opening and closing the light guide panels 38 activates and deactivates the light source 42 in the same manner as described in the preferred embodiment.

Using the lit billfold includes the steps of placing a restaurant check or other document into a document securing means 20 by inserting the bottom edge of the document into a strap 22 located along the bottom edge of the inner surface of the front 12 or back cover 13 or located along the bottom edge of a rigid partition 60; removing the hatch door 34 from the power source housing 24; installing the power source 30 into the power terminal 26; reattaching the hatch door 34; opening the light guide panel 38 to activate the light source 42; adjusting the angle of the light guide panel 38 to optimize the illumination of the restaurant check or other document; and finally allowing the light guide panel 38 to close to deactivate the light source 42.

With respect to the above description, it is to be realized that, to achieve the optimum relationships for the parts, consideration must be made to variations in size and dimension, materials, shape, form, function, and the manner of operation, assembly, and use. Such considerations are intended to be encompassed by the present invention, and will be readily apparent and obvious to one skilled in the art. All suitable modifications, adaptations, and equivalents may be resorted to, falling within the scope of the invention. Although one embodiment has been illustrated in the accompanying drawings and described in the foregoing detailed description, it will be understood that the intention is not limited to the embodiment discussed, but is capable of numerous rearrangements, modifications, and substitutions without departing from the spirit and scope of the invention. Other changes, and uses within the scope of the invention, as defined by the appended claims, will suggest themselves to those versed in the art. This application is intended to cover such departures from the present disclosure as those falling within known or customary practice in the art to which this invention pertains, and which falls within the limits of the appended claims.

It will be noted that this invention fully meets the objectives set forth.

The invention claimed is:

1. A lit billfold device comprising:
a. A front cover;
b. A back cover;
c. A spine;
d. A credit card pocket;
e. A document securing means;
f. A power source housing;
g. A power terminal;
h. A power control regulator;
i. A power source; and
j. A means of illuminating a document including a light guide panel, a set of light guide panel magnets, a light source, and a switch means.

2. The lit billfold device as recited in claim 1, wherein said document securing means is a plurality of straps.

3. The lit billfold device as recited in claim 1, wherein said power source housing includes a hatch door removably attached thereto.

4. The lit billfold device as recited in claim 1, wherein said power source is a plurality of batteries.

5. The lit billfold device as recited in claim 1, wherein said light source is a plurality of light emitting diodes.

6. The lit billfold device as recited in claim 1, wherein said switch means further comprises:
a. A switch magnet; and
b. A reed switch.

7. A lit billfold device comprising:
a. A front cover;
b. A back cover;
c. A rigid partition;
d. A spine;
c. A credit card pocket;
f. A document securing means;
g. A power source housing;
h. A power terminal;
i. A power control regulator;
j. A power source;
k. A means of illuminating a document including a light guide panel, a set of light guide panel magnets, a light source, and a switch means.

8. The lit billfold device as recited in claim 7, wherein said document securing means is a plurality of straps.

9. The lit billfold device as recited in claim 7, wherein said power source housing includes a hatch door removably attached thereto.

10. The lit billfold device as recited in claim 7, wherein said power source is a plurality of batteries.

11. The lit billfold device as recited in claim 7, wherein said light source is a plurality of light emitting diodes.

12. The lit billfold device as recited in claim 7, wherein said switch means further comprises:
a. A switch magnet; and
b. A reed switch.

13. A method for displaying and illuminating a document comprising the steps of:
a. Placing the document into a document securing means by inserting the bottom edge of the document into a strap located along the bottom edge of the inner surface of a front or back cover or located along the bottom edge of a rigid partition;
b. Connecting a power source to a power terminal, which is connected to a power control regulator, which is in turn is connected to a document illumination means including a light guide panel, a set of light guide panel magnets, a light source, and a switch means; and
c. Opening the light guide panel to activate the document illumination means.

* * * * *